United States Patent [19]

Lyon

[11] Patent Number: 4,561,560

[45] Date of Patent: Dec. 31, 1985

[54] LIQUID CONTAINER HAVING SLIDING CLOSURE MEANS

[76] Inventor: Christopher J. Lyon, 4668 Via Roblada, Santa Barbara, Calif. 93110

[21] Appl. No.: 664,722

[22] Filed: Oct. 25, 1984

[30] Foreign Application Priority Data

Oct. 10, 1984 [GB] United Kingdom ..... 8425611

[51] Int. Cl.[4] ..... B65D 17/44

[52] U.S. Cl. ..... 220/278; 220/345

[58] Field of Search ..... 220/278, 345, 85 H

[56] References Cited

U.S. PATENT DOCUMENTS 2,501,653 3/1950 Boak ..... 220/278

4,257,537 3/1981 Uhlig ..... 220/345

*Primary Examiner*—George T. Hall

*Attorney, Agent, or Firm*—Jones, Tullar & Cooper

[57] ABSTRACT

A liquid container comprises an open topped vessel of generally rectangular cross-section with a handle on one side wall and a lid pivoted to that side wall. The lid has projecting puncture means which pierce the top of a sealed, semi-rigid container of a beverage, such as fruit juice, when the container is located in the vessel and the lid is closed. A slider closure member is mounted in slideway structure on the top of the lid so as to be slidable along a rectangular path over two apertures to either close or open both the apertures, the path being offset relative to the handle so that the slider can be operated by a thumb of a hand by which the handle is gripped. The apertures communicate with the interior of a semi-rigid container in the vessel via passages in the puncture means when the lid is closed. One of the apertures is an outlet through which the liquid is poured and the other is a vent hole.

9 Claims, 5 Drawing Figures

LIQUID CONTAINER HAVING SLIDING CLOSURE MEANS

DESCRIPTION

This invention relates to liquid containers from which liquid can be poured when required. The invention is concerned especially with containers for beverages such as fruit juice and milk.

Various kinds of semi rigid beverage containers are known. They are designed to be sealed after filling and are provided with cut away or tear off portions which, when cut away or torn off, form an opening through which liquid is to be poured. Such containers cannot be reclosed once opened.

An object of this invention is to provide a container which is usable for beverages and which is reclosable after initial opening.

According to this invention a liquid container comprises a closed vessel, there being two apertures in the top of the vessel, one serving as an outlet through which liquid can be poured from the container and the other serving as a vent hole, wherein a closure member is provided and constrained for sliding movement relative to and in contact with the vessel between one position in which it closes the two apertures and another position in which both the apertures are open to allow discharge of liquid from the container through the outlet.

Preferably the vessel is provided with a handle. The closure member may be offset relative to the handle so that it can be moved between said two positions by application of a thumb of a hand by which the handle is gripped.

The vent hole may be opened by the action of bringing a hole in the closure member into line with it.

The vessel may comprise an open topped portion comprising the base and sides of the vessel and including the handle, and a hinged lid pivoted relative to the open topped portion, the apertures being formed in the lid and the closure member being constrained for sliding movement on the lid.

The closure member may be a flat elongate slider which is constrained for lengthwise rectilinear sliding movement relative to the vessel. An upstanding abutment may be formed at the end of the slider that is nearer to the handle. The abutment may have, at the end of the slider, an end face which is substantially normal to the direction of sliding movement, and an oblique face which slopes away from the end face towards the upper surface of the slider. A layer of elastomeric material, such as neoprene, may be formed on the undersurface of the slider, and the means whereby the slider is constrained for sliding relative to, and in contact with the vessel may cause the elastomeric material to be slightly compressed in reaction to its contact with the vessel. The means that constrain the slider for sliding movement relative to the vessel may form a stop surface with which the upstanding abutment cooperates to limit sliding movement of the slider away from the handle when the slider is in said one position. The slider may be provided with another abutment which cooperates with another stop surface formed by said constraining means to limit sliding movement away from said one position when the slider is in the other position. Alternatively there may be no such other abutment so that the slider can be removed to facilitate cleaning.

In an embodiment in which the apertures are formed in a lid which is pivoted to an open topped portion of the vessel, the apertures may be associated with respective puncture means which depend from the lid and which have passages therein which provide for communication between the interior of the vessel and each aperture whereby the act of closing the lid on an appropriate sealed semi-rigid liquid container placed within the open topped portion causes the top of the semi-rigid liquid container to be pierced by the puncture means so that liquid contained therein can be poured through the outlet via the respective passage in the puncture means when the closure member is in its other position. Such a liquid container may be in combination with at least one insert which is adapted to be placed within the open topped portion whereby to form a false bottom of the interior of the vessel such that different sizes of semi-rigid liquid container can be accommodated within the vessel so that their top is pierced by the puncture means during closing of the lid.

One form of liquid container in which this invention is embodied and a modification of that form will be described now by way of example with reference to the accompanying drawings, of which:

FIGS. 1 to 4 show a liquid container which comprises an open topped vessel 10 of generally rectangular cross-section formed of a rigid plastics material. The vessel 10 comprises a base and four side walls and is provided with a handle 11 on one, 11A, of its side walls. A lid 12 is hinged to the side wall 11A above the handle 11 and is pivotable between one position shown in full lines in FIG. 1 in which it closes the top of the vessel 10 and another position in which the vessel 10 is open for filling.

The container is designed to be filled by being loaded with a sealed semi-rigid rectangular container which is full of a beverage such as fruit juice. The sealed semi-rigid container is placed on the bottom of the vessel 10 and its height is such that its top is approximately at the top of the vessel 10.

Figure 2:
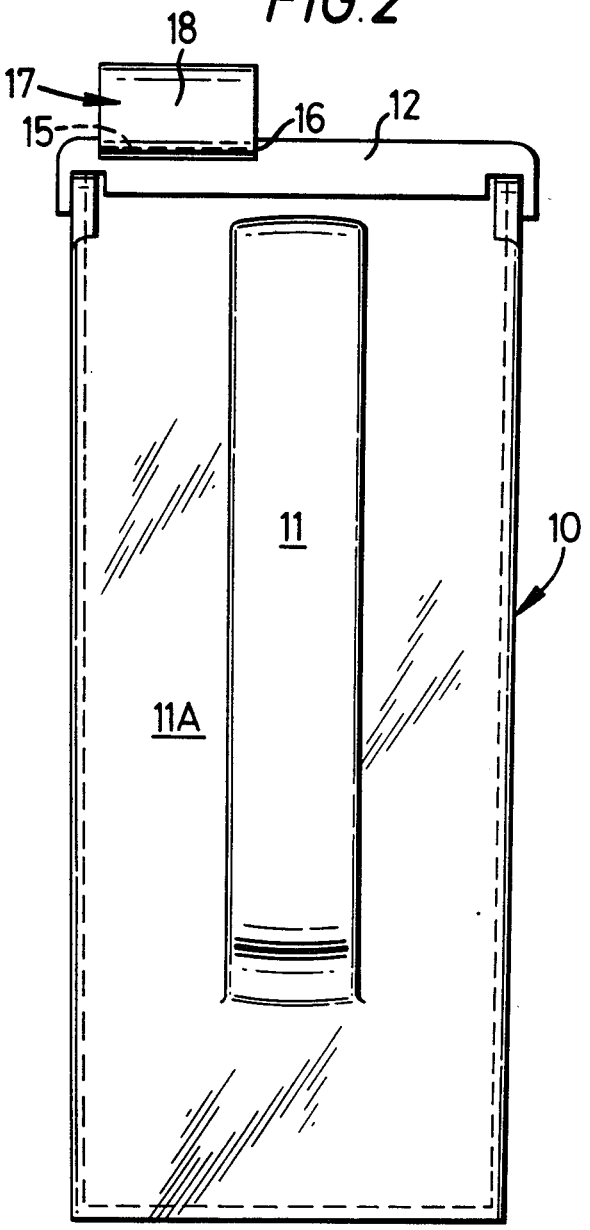
FIG. 2 is an end elevation of FIG. 1 as seen from the right in FIG. 1.
Figure 3:
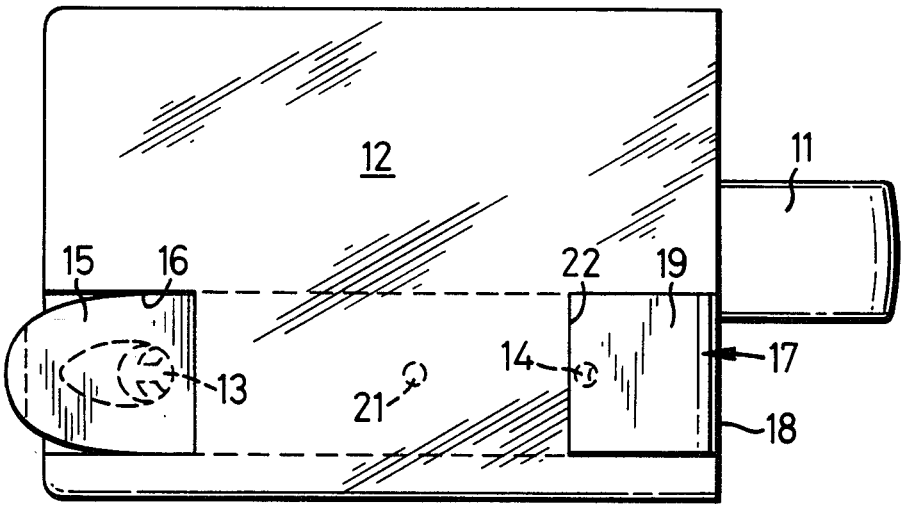
FIG. 3 is a plan of FIG. 1.
Figure 4:
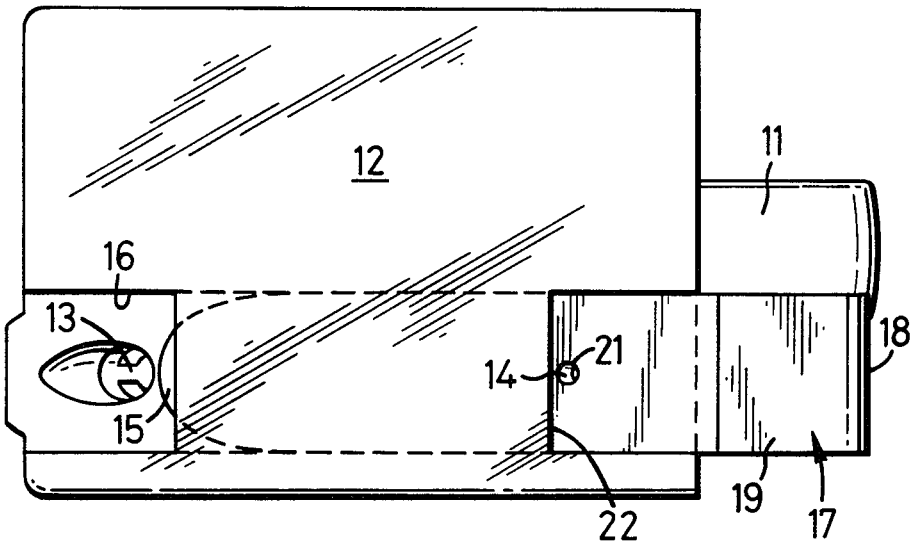
FIG. 4 is a view similar to FIG. 3 but with the container in its pouring mode.

Two apertures 13 and 14 (see FIGS. 3 and 4) are formed in the lid 12. The apertures 13 and 14 are both offset to the left, as seen in FIG. 2, of the handle 11. The aperture 13 is adjacent the edge of the lid 12 remote from the handle 11. It serves as an outlet through which liquid is poured from within the vessel 10 when the lid 12 is closed and it is profiled at its upper end to form a spout. The other aperture 14, which has a smaller diameter than the aperture 13 and which is nearer to the hinge, serves as a vent hole.

Each aperture 13, 14 is associated with a respective depending puncture projection 13A, 14A which is formed integrally with the lid 12 from which it depends. Each puncture projection 13A, 14A tapers to a point at its lower end and has a respective passage formed through it by which the respective aperture 13, 14 communicates with the interior of the vessel 10 when the lid 12 is closed. When the vessel 10 has been loaded with a sealed semi-rigid rectangular container of a beverage such as a fruit juice, the action of closing the lid 12 causes the puncture projections 13A and 14A to pierce the top of the semi-rigid container so that the lower end of the passage through each projection 13A, 14A communicates with the interior of the semi-rigid container.

An elongate flat slider 15 is constrained in slideway structure 16 formed on the top of the lid 12 for rectilinear sliding movement on the surface of the lid 12 over the two apertures 13 and 14. An upstanding abutment 17 is formed at the end of the slider 15 nearer to the handle 11. The end surface 18 of the abutment 17 at the end of the slider 15 is normal to the flat major portion of the slider 15. The remainder of the abutment 17 has an oblique surface 19 which slopes from the upper end of the end surface 18 to the upper surface of the major flat portion of the slider 15. A hole 21 is formed in the major flat portion of the slider 15 at a location which is spaced from the end of the slider remote from the abutment 17 by a distance which is less than the spacing of the apertures 13 and 14. The hole 21 is positioned in the slider 15 such that it can be aligned with the vent hole 14. It will be understood that the outlet opening 13 is uncovered by the slider when the hole 21 is aligned with the vent hole 14.

The slideway structure 16 forms a stop surface 22 which cooperates with the upstanding abutment 17 to limit sliding movement of the slider 15 away from the hinge. The slider 15 is of sufficient length that it covers the outlet opening 13 when the abutment 17 abuts the stop surface 22. It will be noted from FIG. 3 that the vent hole 14 is also covered by the slider 15 in this condition, the hole 21 being out of alignment with it.

The underside of the slider 15 may be lined with a layer of elastomeric material which is slightly compressed from its natural relaxed condition by being squeezed between the rigid portion of the slider 15 and the lid 12. The elastomeric material serves to seal the apertures 13 and 14.

To pour liquid from a semi-rigid container loaded into the vessel 10, after closing the lid 12, one grasps the vessel 10 by the handle 11, engages the oblique surface 19 of the slider 15 with one's thumb and withdraws the slider 15 towards the handle 11 by an action similar to the cocking of a pistol so as to uncover the outlet opening 13 and open the vent hole 14 by aligning the hole 21 with it. Liquid can now be poured from the semi-rigid container within the vessel 10 through the opening 13. After pouring liquid from the semi-rigid container, assuming that it is not empty, one would reclose the outer container by engaging the thumb with the flat end surface 18 of the slider 15 and pushing the slider 15 back until stopped by engagement of the abutment 17 with the stop surface 22. The outer container, and hence the semi-rigid container within it, is now fully closed and sealed for storage.

The slider 15 can be withdrawn from the slideway structure 16 when the vessel 10 is empty to facilitate cleaning.

Figure 1:
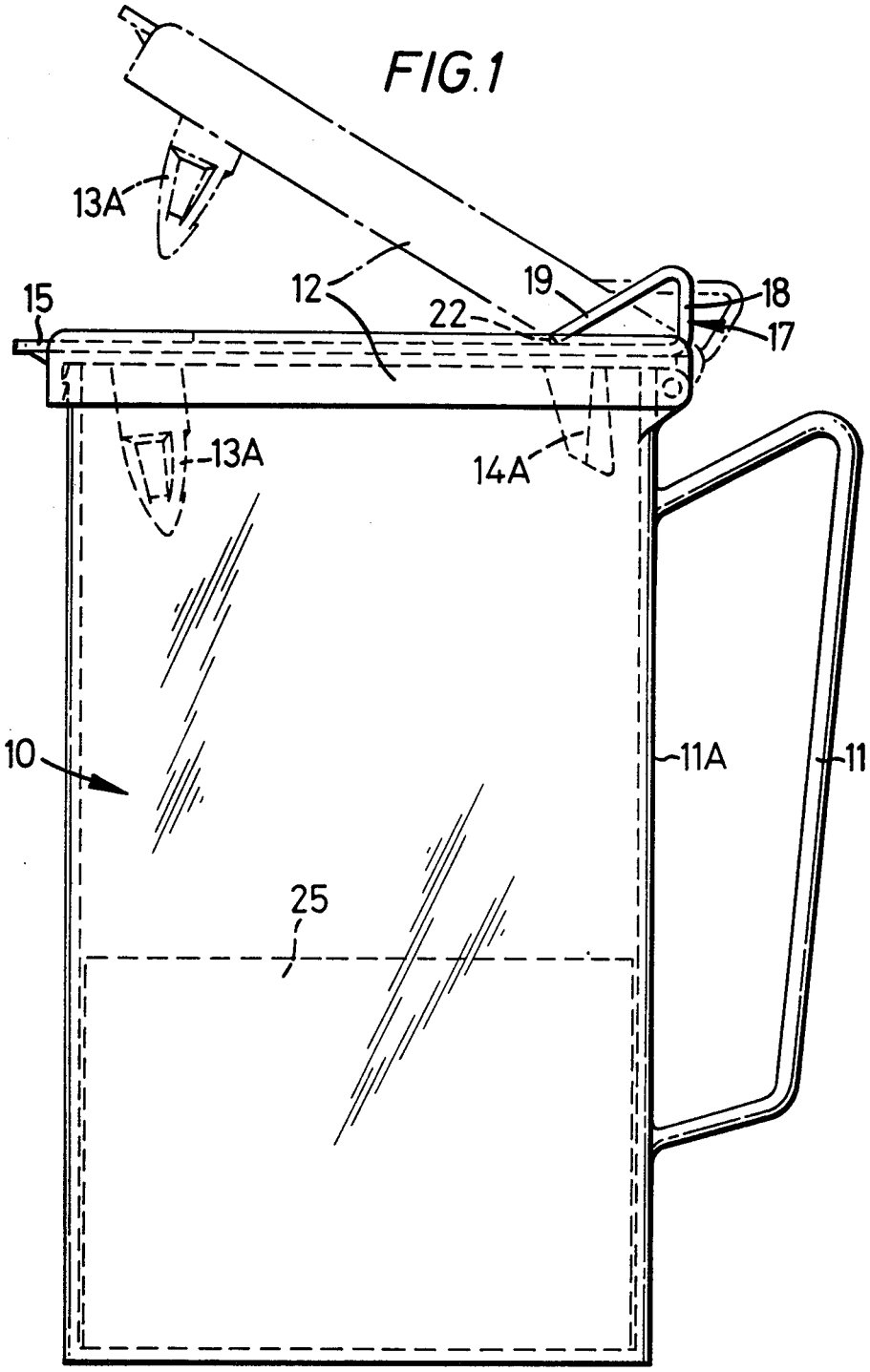
FIG. 1 is a side elevation of the container in its storage mode, a partially-open position of a lid being shown chain dotted.

The internal volume of the vessel 10 may be varied by the use of inserts, such as is shown dotted in FIG. 1, which are placed in the bottom of the vessel 10 to form a false bottom for a respectively sized semi-rigid container.

Figure 5:
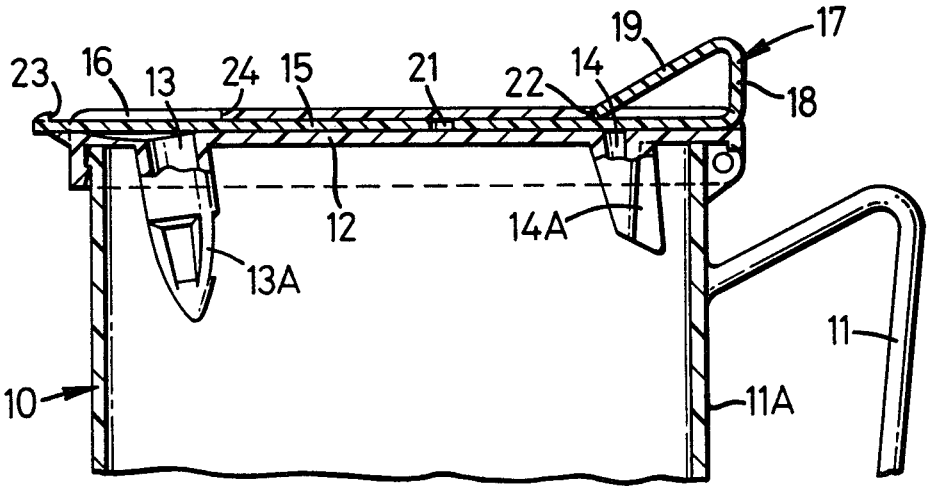
FIG. 5 is a sectioned fragment of a modified form of the container shown in FIGS. 1 to 4.

FIG. 5 shows a modified form of the container described above with reference to FIGS. 1 to 4. The end of the bridge portion of the slideway structure 16 remote from the stop surface 22 forms another stop surface 24 which cooperates with another upstanding abutment 23 formed on the upper surface of the slider 15 to prevent the slider 15 from being slid further towards the handle 11 when the hole 21 is aligned with the vent hole 14.

I claim:

1. A liquid container comprising a closed vessel, there being two apertures in the top of the vessel, one serving as an outlet through which liquid can be poured from the container and the other serving as a vent hole, a closure member and constraining means whereby the closure member is constrained for sliding movement relative to and in contact with the vessel between one position in which it closes the two apertures and another position in which both the apertures are open to allow discharge of liquid from the container through the outlet; wherein the vessel is provided with a handle and the closure member is offset relative to the handle so that it can be moved between said two positions by application of a thumb of a hand by which the handle is gripped.

2. A liquid container comprising a closed vessel, there being two apertures in the top of the vessel, one serving as an outlet through which liquid can be poured from the container and the other serving as a vent hole, a closure member and constraining means whereby the closure member is constrained for sliding movement relative to and in contact with the vessel between one position in which it closes the two apertures and another position in which both the apertures are open to allow a discharge of liquid from the container through the outlet; the closure member being a flat elongate slider which is constrained by said constraining means for lengthwise rectilinear sliding movement relative to the vessel; wherein a layer of elastomeric material is formed on the underside of the slider, and the means whereby the slider is constrained for sliding movement relative to, and in contact with the vessel causes the elastomeric material to be slightly compressed in reaction to its contact with the vessel.

3. A liquid container comprising a closed vessel which comprises an open topped portion and a hinged lid, the open topped portion comprising a base and sides of the vessel, the hinged lid being pivoted relative to the open topped portion and having two apertures formed in it, one of the apertures serving as an outlet through which liquid can be poured from the container and the other serving as a vent hole; a closure member; constraining means on the lid whereby the closure member is constrained for sliding movement relative to and in contact with the lid between one position in which it closes the two apertures and another position in which both the apertures are open to allow discharge of liquid from the container through the outlet; and puncture means associated with each aperture and depending from the lid, there being passages in each puncture means which provide form communication between the interior of the vessel and each aperture when the lid is closed, whereby the act of closing the lid on an appropriate sealed liquid container placed within the open topped portion causes the top of the sealed liquid container to be pierced by the puncture means so that liquid contained therein can be poured through the outlet via the respective passage in the puncture means when the closure member is in its closed position.

4. A liquid container according to claim 1, wherein the vessel comprises an open topped portion comprising the base and sides of the vessel and including the handle, and a hinged lid pivoted relative to the open topped portion, the apertures being formed in the lid and the closure member being constrained by said constraining means for sliding movement on the lid.

5. A liquid container according to claim 1, wherein the closure member is a flat elongate slider which is constrained for lengthwise rectilinear sliding movement relative to the vessel, and an upstanding abutment is formed at the end of the slider that is nearer to the handle.

6. A liquid container according to claim 5, wherein the abutment has, at the end of the slider, an end face which is substantially normal to the direction of sliding movement, and an oblique face which slopes away from the end face towards the upper surface of the slider.

7. A liquid container according to claim 5, wherein said constraining means form a stop surface with which the upstanding abutment cooperates to limit sliding movement of the slider away from the handle when the slider is in said one position.

8. A liquid container according to claim 7, wherein the slider is provided with another abutment which cooperates with another stop surface formed by said constraining means to limit sliding movement away from said one position when the slider is in the other position.

9. A liquid container according to claim 3, in combination with at least one insert which is adapted to be placed within the open topped portion whereby to form a false bottom of the interior of the vessel such that different sizes of semi-rigid liquid container can be accommodated within the vessel so that their top is pierced by the puncture means during closing of the lid.

* * * * *

UNITED STATES PATENT AND TRADEMARK OFFICE

CERTIFICATE OF CORRECTION

PATENT NO. : 4,561,560

DATED : December 31, 1985

INVENTOR(S) : Christopher J. Lyon

It is certified that error appears in the above-identified patent and that said Letters Patent are hereby corrected as shown below:

Claim 3, line 17, "form" should be --for--;

line 25, change "closed" to --open--.

Signed and Sealed this

*Twenty-ninth* Day of *July 1986*

[SEAL]

*Attest:*

DONALD J. QUIGG

*Attesting Officer*

*Commissioner of Patents and Trademarks*